United States Patent [19]

Vataru et al.

[11] Patent Number: 4,901,786

[45] Date of Patent: Feb. 20, 1990

[54] ENGINE COOLANT FLUSH-FILTERING USING EXTERNAL GAS PRESSURE AND RADIATOR VALVING

[75] Inventors: Marcel Vataru, Los Angeles; James L. Baylor, Fontana, both of Calif.

[73] Assignee: Wynn Oil Company, Fullerton, Calif.

[21] Appl. No.: 256,328

[22] Filed: Oct. 3, 1988

Related U.S. Application Data

[63] Continuation-in-part of Ser. No. 87,696, Aug. 20, 1987, Pat. No. 4,793,403.

[51] Int. Cl.[4] ..... F28G 13/00

[52] U.S. Cl. ..... 165/1; 165/95; 165/119; 165/134.1; 210/167; 210/805

[58] Field of Search ..... 165/1, 95, 119, 134.1; 123/41.14; 210/167, 171, 172, 243, 696, 805; 417/118

[56] References Cited

U.S. PATENT DOCUMENTS

| | | | |
|---|---|---|---|
| 1,742,281 | 1/1930 | Rundlett | 210/790 |
| 3,002,909 | 10/1961 | Heidt | 204/148 |
| 3,540,528 | 11/1970 | Moon | 165/119 |
| 3,776,384 | 12/1973 | Offer | 210/209 |
| 3,960,208 | 6/1976 | Anthony et al. | 165/1 |
| 4,128,140 | 12/1978 | Riches | 184/1.5 |
| 4,338,959 | 7/1982 | Krueger et al. | 137/93 |
| 4,390,049 | 6/1983 | Albertson | 141/92 |
| 4,606,363 | 8/1986 | Scales | 134/111 |

FOREIGN PATENT DOCUMENTS

| | | | |
|---|---|---|---|
| 1028634 | 2/1953 | France | 210/167 |
| 2086488A | 5/1982 | United Kingdom | 417/118 |

OTHER PUBLICATIONS

See also U.S. application Ser. No. 033,576, filed Apr. 2, 1987, by assignee of applicants herein.

*Primary Examiner*—Martin P. Schwadron
*Assistant Examiner*—Allen J. Flanigan
*Attorney, Agent, or Firm*—William W. Haefliger

[57] ABSTRACT

A method for rapid cleaning of an internal combustion engine cooling system includes:

(a) forcing the coolant liquid from the cooling system to the exterior of that system, (b) treating the coolant liquid in a zone or zones outside the cooling system, the treating including removing contaminant from the coolant liquid, (c) Returning the treated coolant liquid to the cooling system, (d) the forcing step including supplying a pressurized gas to the cooling system to drive coolant liquid therefrom, (e) the cooling system including a heat radiator including a container having a coolant liquid fill opening, and a valve controlled discharge port proximate the bottom of the radiator, and the forcing step including employing the gas to drive coolant liquid from the radiator via the discharge port.

17 Claims, 2 Drawing Sheets

ENGINE COOLANT FLUSH-FILTERING USING EXTERNAL GAS PRESSURE AND RADIATOR VALVING

This application is a continuation-in-part of Ser. No. 087,696, filed Aug. 20, 1987, now U.S. Pat. No. 4,793,403.

BACKGROUND OF THE INVENTION

This invention relates generally to cleaning of an internal combustion engine cooling system, more particularly to treatment of used coolant exteriorly of such a system for subsequent return to the system.

Studies show that over-heating is a major cause of vehicle breakdown on highways. Engine cooling systems must operate efficiently at all times to avoid costly repairs that result from excessive temperature. In this regard, cooling systems contaminated by rust, scale build-up and sludge cannot provide adequate heat transfer and cooling system efficiency; in addition, thermostats fail to open, hoses deteriorate, impellers bind or break-off, and engine blocks can become distorted or crack. Accordingly, there is a need for efficient engine cooling system flushing methods and apparatus; however, flushing of such systems in the past required draining of the removed liquid to sewer or waste lines, which was environmentally objectionable. Accordingly, need has developed for apparatus and method to clean engine coolant systems without such drainage. No way was known for accomplishing this objective in the unusually advantageous manner as is now provided by this invention.

SUMMARY OF THE INVENTION

It is a major object of the invention to provide procedures and apparatus characterized as overcoming the above objections and as meeting the above needs, whereby efficient, rapid cleaning of the engine coolant system may be accomplished in an environmentally non-objectionable manner.

Basically, the method of the invention embodies the steps:

(a) forcing the liquid coolant from the cooling system to the exterior of that system, (b) treating the coolant liquid in a zone or zones outside the cooling system, said treating including removing contaminant from the coolant liquid, (c) returning the treated coolant liquid to the cooling system, (d) said forcing step including supplying a pressurized gas to the cooling system to drive coolant liquid therefrom, (e) the cooling system including a heat radiator including a container having a coolant liquid fill opening, and a valve controlled discharge port proximate the bottom of the radiator, and said forcing step including employing said gas to drive coolant liquid from the radiator via said discharge port.

It is another objective of the invention to supply a pressurized gas such as air to the cooling system in such a way as to drive coolant therefrom, for external treatment as in a holding tank zone.

Another objective is to provide a path for pressurized coolant to exit the radiator from its lower interior, for external treatment, while a radiator fill port is maintained closed to prevent injury to the user, which could occur by hot fluid discharge from the radiator interior, via an open fill port.

Additional steps include filtering contaminant particulate from the coolant as it flows to the external treatment zone; employing gas pressure to drive the coolant from the holding zone back to the coolant system at the engine, and filtering the returning coolant.

A further objective is to employ the driving gas pressure to test the coolant system for any leakage.

These and other objects and advantages of the invention, as well as the details of an illustrative embodiment, will be more fully understood from the following specification and drawings, in which:

DRAWING DESCRIPTION

DETAILED DESCRIPTION

Figure 1:
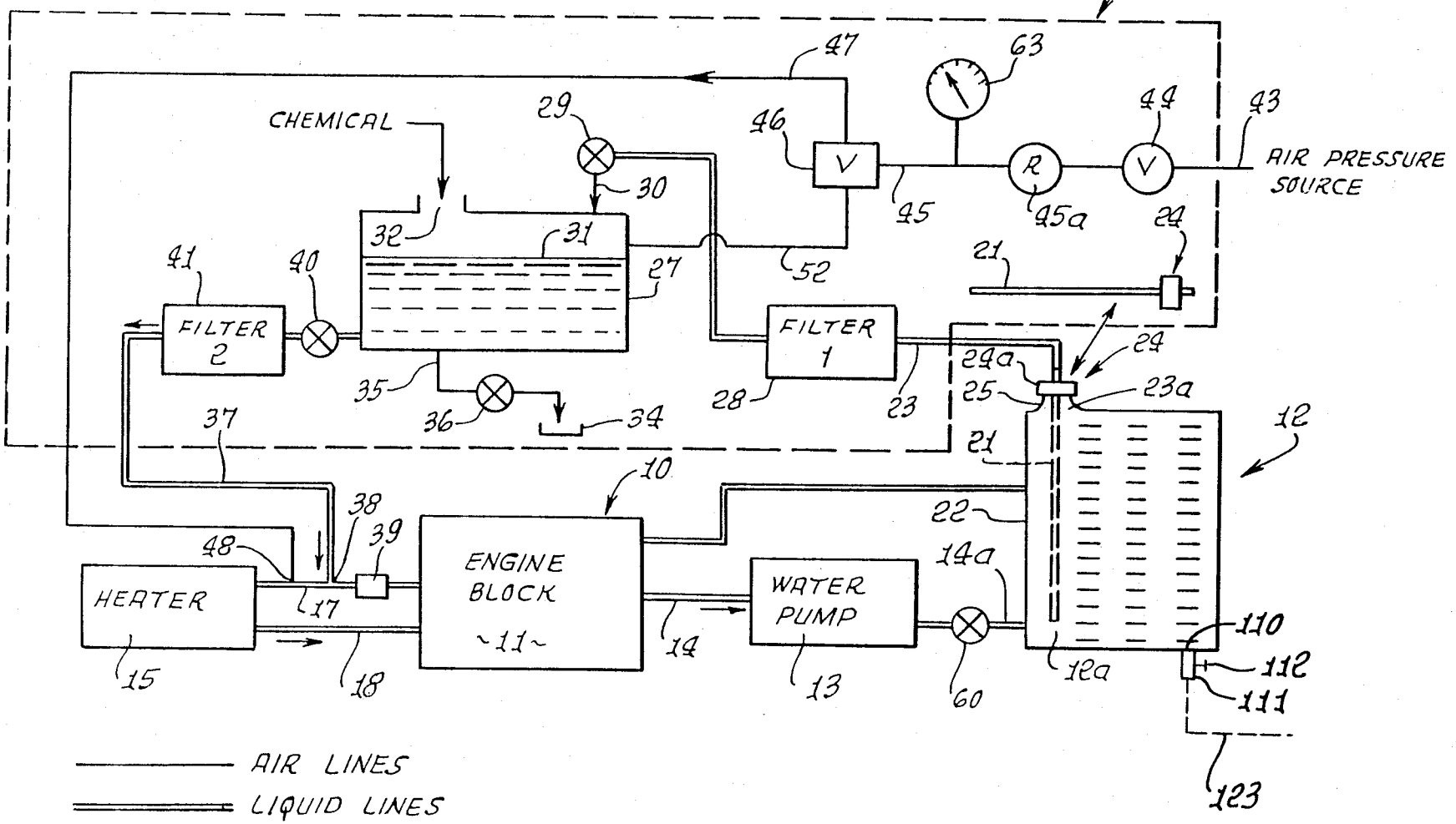
FIG. 1 is a schematic view of apparatus employing the invention.

In FIG 1, there is schematically shown as internal combustion engine 10 having a block 11 defining coolant passages through which liquid coolant (such as water, and anti-freeze additive including polyethylene glycol, etc.) is adapted to pass; a radiator 12; and a coolant pump 13 connected to pump coolant between the block and radiator, as via lines or ducts 14 and 14*a*. Also shown is a heater 15 connected at 17 with the block, as for use in a vehicle to be heated. From the heater, coolant may pass at 18 to the engine block 11. During continued operation of the engine, the coolant tends to become contaminated with particulate such as rust particles and precipitate (calcium salts, etc.), and the additive degenerates. In the past, the coolant was drained from the system as to sewer lines, and the system flushed with liquid which was also drained. The present invention eliminates such environmentally objectionable draining, and also protects the operator.

In accordance with the invention, apparatus generally designed at 20 is provided, and comprises:

(a) first means for forcing the coolant liquid from the cooling system to the exterior of that system, (b) second means in communication with said first means for receiving the coolant liquid at the exterior of the cooling system, for treatment thereof, and (c) third means in communication with said second means for returning the treated coolant liquid to the cooling system.

While specific means are shown within the overall block 20, it will be understood that other, or equivalent means are usable to perform the following steps:

(a) forcing the liquid coolant from the cooling system to the exterior of that system, (b) treating the coolant liquid in a zone or zones outside the cooling system, said treating including removing contaminant from the coolant liquid, and (c) returning the treated coolant liquid to the cooling system.

In this regard, it will be noted that the method and apparatus makes possible the re-use of the coolant by withdrawing it from the coolant system, treating it externally of that system, and re-circulating the rejuvenated coolant back into the system so as to avoid need for disposal of the coolant as by drainage to the environment.

The specific means illustrated incorporates multiple and unusual advantages in terms of simplicity, effectiveness and rapidity of employment and operation; for example, the first means for forcing the liquid coolant from the coolant system may advantageously include a coolant discharge port 110 at the bottom of the radiator, in series with a valve 111, manually controlled at 112, for return of air pressurized coolant from the lower interior or extent of the radiator, i.e. for passage from the radiator as via duct 123, and return to tank 27, such a valve temporarily replacing the original equipment valve.

Means 24 is provided for maintaining the usual radiator fill opening 23*a* otherwise closed during removal of coolant from the radiator. Such means may comprise a screw-on cap 24*a* which is located above the upper interior 12*b* of the radiator, above finned tubes 104. Cap 24*a* is screwed onto the neck of the radiator fill-opening, as at screw connection 93, 94. Valve 111 at the bottom wall 109 of the radiator container communicates with the bottom interior 12*a* of the container so that substantially all pressurized coolant liquid may be removed, extracted or drained from the radiator, to the line 123. As will appear, liquid in the heater and engine block flows to the radiator for such removal.

Modified cap 24*a* for fill port 23*a* has a domed wall 90 with a central through opening 91 usable for example to induce a vacuum at the upper interior 12*b* of the radiator. See siphon bulb 294 in series with bypass valve 98 in FIG. 2. A seal 92 carried by the cap seals off when a threaded fitting 152 is tightened in threaded bore 151, to close the cap 24*a*. The cap has a lower lip 93 that tightens on the annular lip 94 of the radiator container, as shown, at which time an annular extension 149 fits in radiator bore 153, sealing at 154.

An offset through port 95 in wall 90 has a by-pass duct 96 connected therewith, at 97, and a manually controllable by-pass valve 98 in duct 96 controls escape of pressurized fluid from the radiator upper interior 12*b* to an over-flow tank 100. Valve 98 is opened, as during air pressurized and induced return of treated coolant fluid to the system, that fluid normally allowed to rise in the radiator to level 101 above radiator core 104. Any excess fluid (air to coolant, or both) rising in the radiator exits via the by-pass duct and valve 98 to tank 100. Thus, hot fluid under pressure cannot freely discharge in direction 102 outside, since the radiator fill port 23*a* is closed by cap 24*a*, with fitting 152 installed in bore 151. By-pass valve 98 is also used with a siphon-vacuum bulb 294, to induce vacuum at 12*b*, as when original equipment fitting is removed from bottom of radiator and special coolant discharge port or duct 110 is installed into bottom of radiator at 109, in series with valve 111.

Coolant collected in tank 100 can be siphoned out and returned to tank 27, as by a siphon which includes hose 107 and bulb 106. Radiator shell or container 109 contains core 104. Alternatively, the first means for forcing the liquid coolant from the coolant system may advantageously include an elongated tube or tubular probe 21 insertible endwise into the outer container or shell 22 incorporated by the radiator, and via the port 151 in cap 24*a*, to extract coolant from the lower interior or extent of the radiator, for passage from the radiator as via return duct 23.

The second means for treating the removed coolant may advantageously comprise a liquid receiver, such as for example a holding tank 27 to which liquid flows via line 23, filter 28 connected in series with that line, and valve 29 in the line. Particulate and congealed substances in the flowing liquid are removed by the filter 28, which may be replaced at intervals; the used-up filter then being disposed of in accordance with environmentally acceptably safe procedures. The normally aqueous liquid received into the holding tank interior zone 31, as via inlet 30 may then be treated. Chemicals to be added to the radiator, after return of treated coolant to the radiator include corrosion inhibitor i.e. anti-rust compound, pH adjustment chemicals, and fresh anti-freeze compound (glycol, for example). If any sludge develops in tank 27 after prolonged use, it may be removed to a container 34 and disposed of, environmentally safe. See line 35 and valve 36.

The third means for returning the treated coolant to the engine cooling system includes a line or duct 37 extending from tank 27 to a connection 38 with the cooling system. Connection 38 is advantageously located in the line 17 from the block 11 to the heater. A clamp 39 may be located on or at that line for stopping liquid passing from 38 to the block, via line 17. A control valve 40 and a filter 41 are connected in series with line 37, valve 40 being opened when return of coolant to the system is desired. Filter 41 removes any further contaminant.

An important feature of the apparatus is the provision, in association with the first means referred to above, of a pressurized gas (as for example air pressure) source 43 connectible via a main valve 44 in duct 45 and a control valve 46, connected via duct 47 with the coolant system, for forcing coolant from the system and to tank 27 (as via line 23). Line 47 may be connected to duct 17, at 48, as shown. Air pressure then drives coolant from the heater to the radiator, as via line 18, and the pump 13, coolant also flowing from the block to the radiator lower interior extent, for removal. Such lower extent appears at 12*a*.

Valve 46 is advantageously a three-way valve, and is thus controllable to alternatively supply air under pressure via line 52 to the holding tank interior for application to treated liquid 31 in the tank for return supply under pressure to the engine cooling system, along the flow path described above.

Prior to initial operation of the system, the engine is operated to heat the coolant in the system, and as a result a thermostat controlled valve in that system, indicated at 60, is opened when the coolant reaches a predetermined temperature. Rust loosening our cleaning chemical additive (such as detergent solution) may be initially added to the coolant in the radiator to circulate during warm-up. Operation of the apparatus is begun. Note that the apparatus is quickly connectible to the cooling system, as via hoses or lines 23, 37 and 47.

Finally, a pressure gauge 63 is connected to air line 45 to indicate the pressure in that line. After air pressure has returned the treated coolant to the system, the radiator fill opening 23*a* is closed as by returning the radiator cap to neck 25, and tightening it to seal the opening 23*a*. Thereafter air pressure from supply 43 pressurizes the entire coolant system, and gauge 63 is observed to note the pressure. Air pressure regulator 45*a* in line 45 regulates the pressure to a safe level. Valve 44 is then closed, and the gauge 63 is again observed to note any relatively rapid fall-off of pressure. If that does not occur, the pressure test indicates a non-leaking system; however, if the pressure falls-off, the test indicates that a leak gas developed in the coolant system, and should be attended to. For example, a STOP-LEAK solution may be added to the contents of the radiator in an effort to arrest the pressure leak.

SUMMARY OF THE INVENTION

Figure 2:
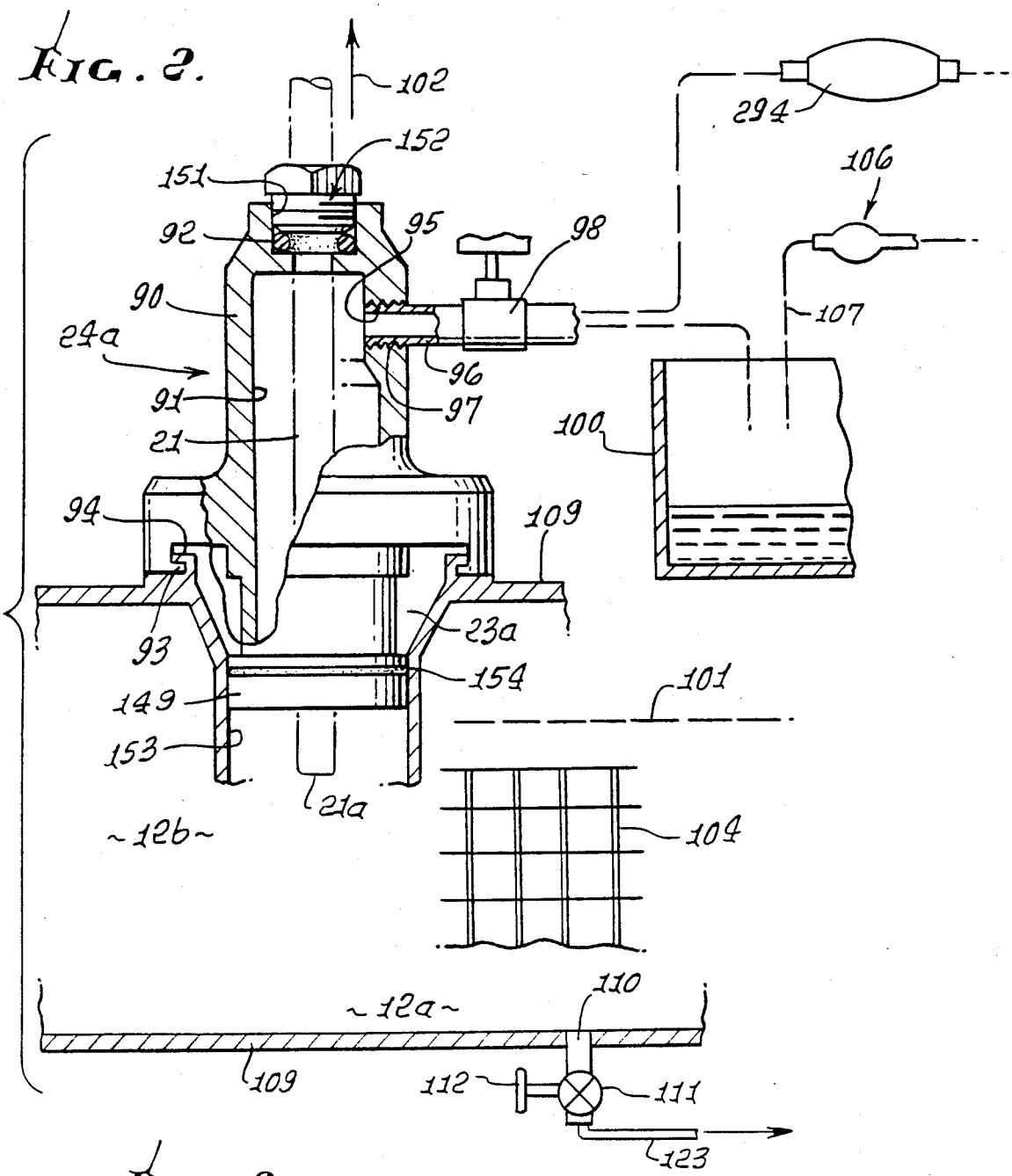
FIG. 2 is an enlarged section showing details of a radiator fill-port closure, a by-pass valve, and drain valve.

The following is a summary of steps that may be carried out during performance of the method of the invention:

(1) Add cleaning or flushing chemicals to engine coolant system after preliminarily testing the system for leaks;

(2) Connect apparatus 20 and cap 24*a* to the cooling system as shown in FIGS. 1 and 2, and as described above;

(3) Operate engine for about 10 minutes to circulate the chemicals for loosening dirt, rust, sludge, etc., and also to warm up coolant solution so that thermostat controlled valve 60 opens, at about 190°–205° F.;

(4) Make sure that cap means 24*a* is connected to the lip 94, the cap port 151 plugged by plug 152;

(5) Open valve 44 and adjust valve 46 to direct air pressure to connection 48, which causes air pressure to drive coolant from the system to holding tank 27, via port 110, valve 111, filter 28, and valve 29, which is OPEN;

(6) Close valve 44.

(7) Leave fill-opening 23*a* closed by cap 24*a*. Open by-pass valve 98. Close valve 111;

(8) Open valve 44 and adjust valve 46 to direct air pressure to tank 27, via line 52. Inlet 32 should be closed. This drives coolant from the tank, through filter 41, and to the coolant system at line 17. Coolant rises to level 101 in the radiator. Excess air or coolant fluid vents via by-pass valve 98; and to tank 100.

(9) When all coolant has been returned to the system, the by-pass valve 98 is closed.

(10) Relieve pressure in the system as by slowly opening the valve 98 at the side of cap 24*a*. Any flow via transparent line 96 can be viewed.

(11) Remove cap 24*a* from radiator neck.

(12) Disconnect the hoses or lines from the line 17;

(13) Add treating chemical and anti-freeze (if necessary) to radiator, via open port 23*a*;

(14) A standard radiator cap can then be attached to the radiator neck;

The connections to line 17 may take the form of those described in U.S. Pat. No. 4,109,703, FIG. 12.

Figure 3:
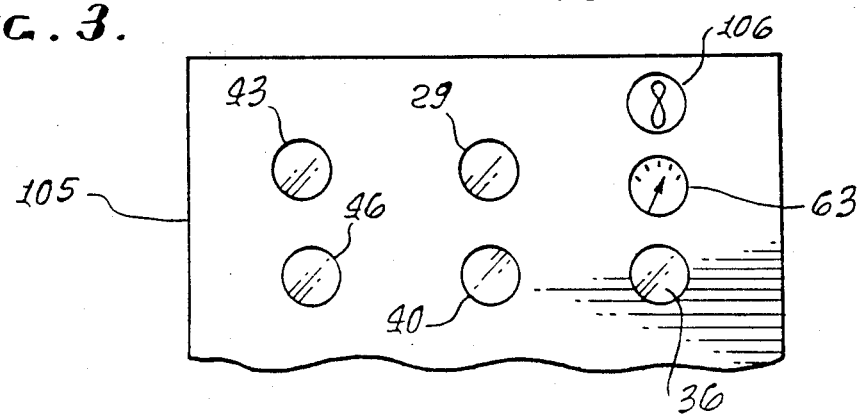
FIG. 3 is a front view of a control console.

FIG. 3 shows valve controls on a console panel 105, along with gauge 63. A flow indicator (spinner) connected into line 17, appears at 106.

We claim:

1. In the method of treating coolant liquid in an internal combustion engine cooling system, the steps that include:

(a) forcing the coolant liquid from the cooling system to the exterior of that system, (b) treating the coolant liquid in a zone or zones outside the cooling system, said treating including removing contaminant from the coolant liquid, and (c) returning the treated coolant liquid to the cooling system, (d) said forcing step including supplying a pressurized gas to the cooling system to drive coolant liquid therefrom, (e) the cooling system including a heat radiator including a container having a coolant liquid fill opening, and a valve controlled discharge port proximate the bottom of the radiator, and said forcing step including employing said gas to drive coolant liquid from the radiator via said discharge port, (f) and including controllably venting fluid including gas from said container, during said step of returning the treated coolant liquid to the cooling system.

2. The method of claim 1 including the step of maintaining said fill opening closed during said forcing step.

3. In the method of treating coolant liquid in an internal combustion engine cooling system, the steps that include:

(a) forcing the coolant liquid from the cooling system to the exterior of that system, (b) treating the coolant liquid in a zone or zones outside the cooling system, said treating including removing contaminant from the coolant liquid, and (c) returning the treated coolant liquid to the cooling system, (d) said forcing step including supplying a pressurized gas to the cooling system to drive coolant liquid therefrom, (e) the cooling system including a heat radiator including a container having a coolant liquid fill opening, and a valve controlled discharge port proximate the bottom of the radiator, and said forcing step including employing said gas to drive coolant liquid from the radiator via said discharge port, and (f) and controllably venting fluid, including gas from said container via said fill opening, during said step of returning the treated coolant to the cooling system.

4. The method of claim 3 including applying a closure to said fill opening, there being a by-pass valve connected with said closure, and carrying out said venting via said by-pass valve.

5. The method of claim 1 wherein said treating step includes filtering contaminant particles from the cooling liquid.

6. The method of claim 1 wherein said treating step includes collecting said coolant liquid in a holding zone, and adding chemical agent or agents to the collected liquid in the holding zone.

7. The method of claim 6 wherein said returning step includes filtering the liquid while returning the liquid from the holding zone to the cooling system.

8. The method of claim 7 wherein the cooling system includes cooling passages in an engine block and in a heater, there being a coolant flow connection passage between said coolant passages in the block and heater, and wherein said returning step includes returning the treated liquid to said flow connection passage.

9. The method of claim 1 wherein said returning step includes supplying pressurized gas to drive treated coolant into the cooling system.

10. The method of claim 7 wherein said returning step includes supplying pressurized gas to the holding zone to drive treated liquid therefrom and to the cooling system.

11. The method of claim 1 wherein said forcing step includes supplying pressurized gas to drive coolant from the radiator.

12. The method of claim 11 including maintaining said fill opening closed during said passage of coolant liquid from the radiator.

13. The method of claim 11 wherein said gas comprises compressed air.

14. The method of claim 1 wherein said gas comprises compressed air.

15. The method of claim 1 wherein the cooling system includes a thermostat controlled valve that only opens when the coolant liquid has reached a predetermined temperature during initial operation of the engine, and including the initial step of operating the engine to heat the coolant to effect opening of said valve, prior to said forcing step.

16. The method of claim is including the step of maintaining that fill opening open during the gas pressure driving of treated liquid to the cooling system so as to pass spent gas from the cooling system.

17. The method of claim 1 including removing excess coolant fluid from the uppermost interior extent of the radiator container following said step of returning treated coolant liquid to the cooling system.

* * * * *